US008710410B2

(12) United States Patent
Gowens et al.

(10) Patent No.: US 8,710,410 B2
(45) Date of Patent: Apr. 29, 2014

(54) TRAY FOR MICROWAVE COOKING AND FOLDING OF A FOOD PRODUCT

(75) Inventors: Patrick A. Gowens, Libertyville, IL (US); Paul Andrew Cogley, Gurnee, IL (US); Erik M. Strilich, Roselle, IL (US)

(73) Assignee: Kraft Foods Group Brands LLC, Northfield, IL (US)

( * ) Notice: Subject to any disclaimer, the term of this patent is extended or adjusted under 35 U.S.C. 154(b) by 861 days.

(21) Appl. No.: 12/553,837

(22) Filed: Sep. 3, 2009

(65) Prior Publication Data

US 2010/0059511 A1 Mar. 11, 2010

Related U.S. Application Data

(60) Provisional application No. 61/094,955, filed on Sep. 7, 2008, provisional application No. 61/094,957, filed on Sep. 7, 2008.

(51) Int. Cl.
*H05B 6/80* (2006.01)

(52) U.S. Cl.
USPC ..... 219/730; 219/759; 219/725; 219/728; 219/732; 99/426; 99/449; 426/243; 426/90

(58) Field of Classification Search
USPC ..... 219/730, 759, 725, 728, 732; 99/449, 99/426; 426/243, 90
See application file for complete search history.

(56) References Cited

U.S. PATENT DOCUMENTS 2,780,163 A 2/1957 Lee
4,228,945 A 10/1980 Wysocki
4,355,757 A 10/1982 Roccaforte
4,505,391 A 3/1985 Kuchenbecker
4,555,605 A 11/1985 Brown et al.
4,592,914 A 6/1986 Kuchenbecker
4,661,672 A 4/1987 Nakanaga
4,705,929 A 11/1987 Atkinson
4,801,774 A * 1/1989 Hart ..... 219/730
4,826,072 A 5/1989 Hart
4,877,932 A 10/1989 Bernstein et al.
4,911,938 A 3/1990 Fisher et al.
5,077,455 A 12/1991 Peleg et al.
5,078,273 A 1/1992 Kuchenbecker
5,095,186 A 3/1992 Russell et al.

(Continued)

FOREIGN PATENT DOCUMENTS

EP 0345523 12/1989
WO 2008052096 5/2008

*Primary Examiner* — Andy Huynh
*Assistant Examiner* — Sitaramarao S Yechuri
(74) *Attorney, Agent, or Firm* — Fitch, Even, Tabin & Flannery LLP

(57) ABSTRACT

A raised platform for microwave cooking of a food product includes legs that extend to elevate a food product support surface above the floor of a microwave oven during cooking. At least one fold line extends across the food product support surface about which the food product support surface and any food product thereon can be folded. Susceptor material of the food product support surface is disposed on both sides of a fold region of the support surface and extends on both sides of the at least one fold line. The fold region is substantially free from the susceptor material allowing a food product heated on the food product surface to remain flexible to permit folding of the food product with reduced cracking or breaking. The raised platform may further include a second susceptor material disposed on a bottom surface of the food product support surface.

34 Claims, 9 Drawing Sheets

(56) References Cited

U.S. PATENT DOCUMENTS

| | | | | |
|---|---|---|---|---|
| 5,144,107 | A | 9/1992 | Peleg | |
| 5,153,402 | A | 10/1992 | Quick et al. | |
| 5,180,894 | A | 1/1993 | Quick et al. | |
| 5,247,149 | A | 9/1993 | Peleg | |
| 5,252,793 | A | 10/1993 | Woods | |
| 5,424,519 | A | 6/1995 | Salee | |
| 5,510,132 | A | 4/1996 | Gallo, Jr. | |
| 5,688,427 | A | 11/1997 | Gallo, Jr. | |
| 5,935,477 | A | 8/1999 | Koochaki | |
| 6,065,394 | A | 5/2000 | Gelderman | |
| 6,102,281 | A | 8/2000 | Lafferty et al. | |
| 6,137,099 | A | 10/2000 | Hamblin | |
| D441,611 | S | 5/2001 | Hudson et al. | |
| 6,359,272 | B1 | 3/2002 | Sadek et al. | |
| 6,415,944 | B1 | 7/2002 | Toussant | |
| 6,476,368 | B2 | 11/2002 | Aronsson et al. | |
| 6,534,755 | B1 | 3/2003 | Paulucci | |
| D514,384 | S | 2/2006 | Mitchell et al. | |
| D524,114 | S | 7/2006 | Dodge et al. | |
| 7,196,299 | B2 | 3/2007 | Hasse et al. | |
| D545,125 | S | 6/2007 | Dodge et al. | |
| 7,491,416 | B2 | 2/2009 | Zhang et al. | |
| 7,525,075 | B1 * | 4/2009 | Watkins et al. | 219/730 |
| 2005/0109772 | A1 | 5/2005 | Thorpe et al. | |
| 2005/0112263 | A1 | 5/2005 | Schmitt | |
| 2005/0184066 | A1 * | 8/2005 | Brooks et al. | 219/730 |
| 2006/0108359 | A1 | 5/2006 | Brough et al. | |
| 2006/0263505 | A1 | 11/2006 | Schmitt | |
| 2006/0289517 | A1 | 12/2006 | Lorbach | |
| 2007/0272088 | A1 | 11/2007 | Gomez | |
| 2007/0275130 | A1 | 11/2007 | Cole et al. | |
| 2008/0000896 | A1 | 1/2008 | Lafferty et al. | |
| 2008/0017635 | A1 | 1/2008 | Watkins | |
| 2008/0023469 | A1 | 1/2008 | Fitzwater | |
| 2008/0110877 | A1 | 5/2008 | Cole | |
| 2008/0164178 | A1 | 7/2008 | Wnek et al. | |
| 2008/0175959 | A1 * | 7/2008 | Hill et al. | 426/90 |
| 2010/0038359 | A1 * | 2/2010 | Laubhan et al. | 219/730 |
| 2010/0055260 | A1 * | 3/2010 | Sweet | 426/243 |

* cited by examiner

TRAY FOR MICROWAVE COOKING AND FOLDING OF A FOOD PRODUCT

CROSS-REFERENCE To RELATED APPLICATION

This application claims benefit of U.S. Provisional Application No. 61/094,955, filed Sep. 7, 2008, and U.S. Provisional Application No. 61/094,957, filed Sep. 7, 2008, which are hereby incorporated herein by reference in their entirety.

FIELD

This disclosure relates to a tray having a susceptor for microwave cooking of a food product, and in particular to a raised tray configured for folding a food product.

BACKGROUND

With the popularity of microwave ovens, attention has focused on providing consumers with kits and components for preparing food products such as frozen or refrigerated pizzas, sandwiches, and other food products. It is known to cook food products in a microwave oven using susceptor technology to brown or crisp the food product. Susceptor material is used to absorb electromagnetic energy and convert that energy into heat. Oftentimes, a food product will be positioned on a layer of susceptor material and placed in a microwave where the susceptor material will absorb the microwave radiation, convert the absorbed energy to heat, and use that heat to cook the food product.

A raised platform having susceptor material may be used to elevate the food product above the bottom floor or turntable of the microwave oven during cooking or heating. As has been detailed in U.S. Publication No. 2006/0210677, a food holder containing a susceptor layer may be used to heat a food item when it is cooked in a microwave oven and can be used to fold the food product after cooking. The susceptor layer is disposed on the entire surface of the food holder such that the surface of the food product that contacts the surface of the food holder is directly heated on the susceptor layer. As a result, the entire food item will be heated or cooked, causing the side contacting the susceptor material of the food item to be crisped or browned. The crisped or browned nature along the underside of the food item can lead to difficulty in folding the food item, and may cause it to crack and/or break during folding.

Additionally, as has been described in U.S. Publication No. 2008/0164178, a microwave platform containing a susceptor layer may be used to heat a food item where the susceptor layer comprises a plurality of spaced susceptor bands or stripes with microwave inactive areas therebetween. The desired result is that, during microwave heating, the bands may form corresponding darkened areas on the outer surface of the food item that resemble grill marks. In practice, however, the susceptor bands may not brown the food product with a sufficient amount of their area, which can create an undesired browning pattern on the food product.

SUMMARY

A raised platform having a susceptor is used for cooking a food product in a microwave oven and folding the food product after cooking is completed. The raised platform has a food product support surface that is elevated above the floor of the microwave oven by depending legs that extend from the food product support surface. The food product support surface includes a weakened fold line disposed within a fold region that extends across the support surface and about which the food product support surface and food product thereon can be folded. Susceptor material is disposed on the food product support surface and extends on both sides of the weakened fold line and is used to crisp or brown the food product during heating in the microwave oven. The food product support surface includes an area free from susceptor material that is located generally within the fold region. The portion of the food product that rests on the area free from susceptor material includes a fold zone that is not crisped or browned to the same extent as portions of the food product in contact with the susceptor material during cooking, and therefore provides the food product with more flexibility during folding. Following heating, this configuration may reduce cracking or breaking when the food product support surface is used to fold the food product after the cooking in the microwave oven.

The raised platform may further include a pattern of susceptor material disposed on the food product support surface and a substantially similar and at least substantially underlapping pattern of susceptor material disposed on a bottom surface of the food product support surface. Following heating, this configuration can more thoroughly brown the desired pattern onto the food product as compared to a single layer of susceptor material on only one side of the support surface. Specifically, it is believed that overlapping the layers of susceptor material increases conductance levels exponentially, particularly with greater degrees of overlap.

DETAILED DESCRIPTION OF THE DRAWINGS

Figure 1:
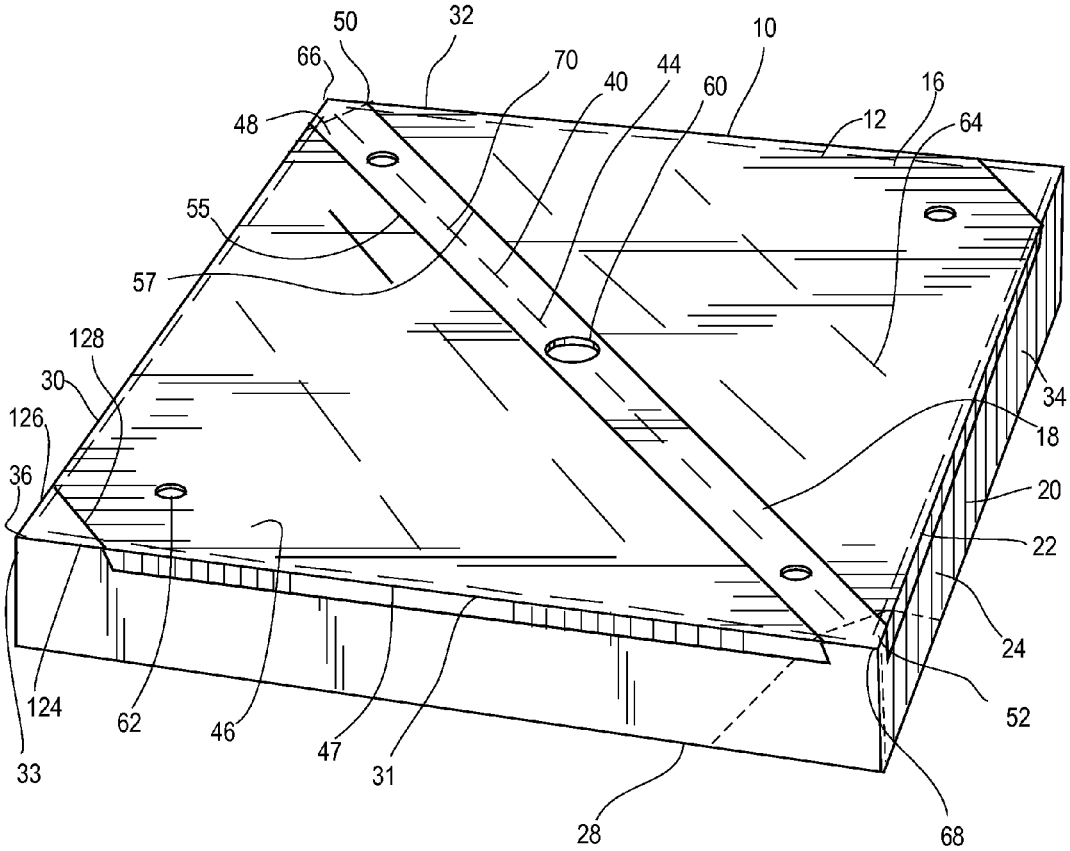
FIG. 1 is a top perspective view of an embodiment of a tray having an elevated food product support surface with a susceptor thereon.
Figure 2:
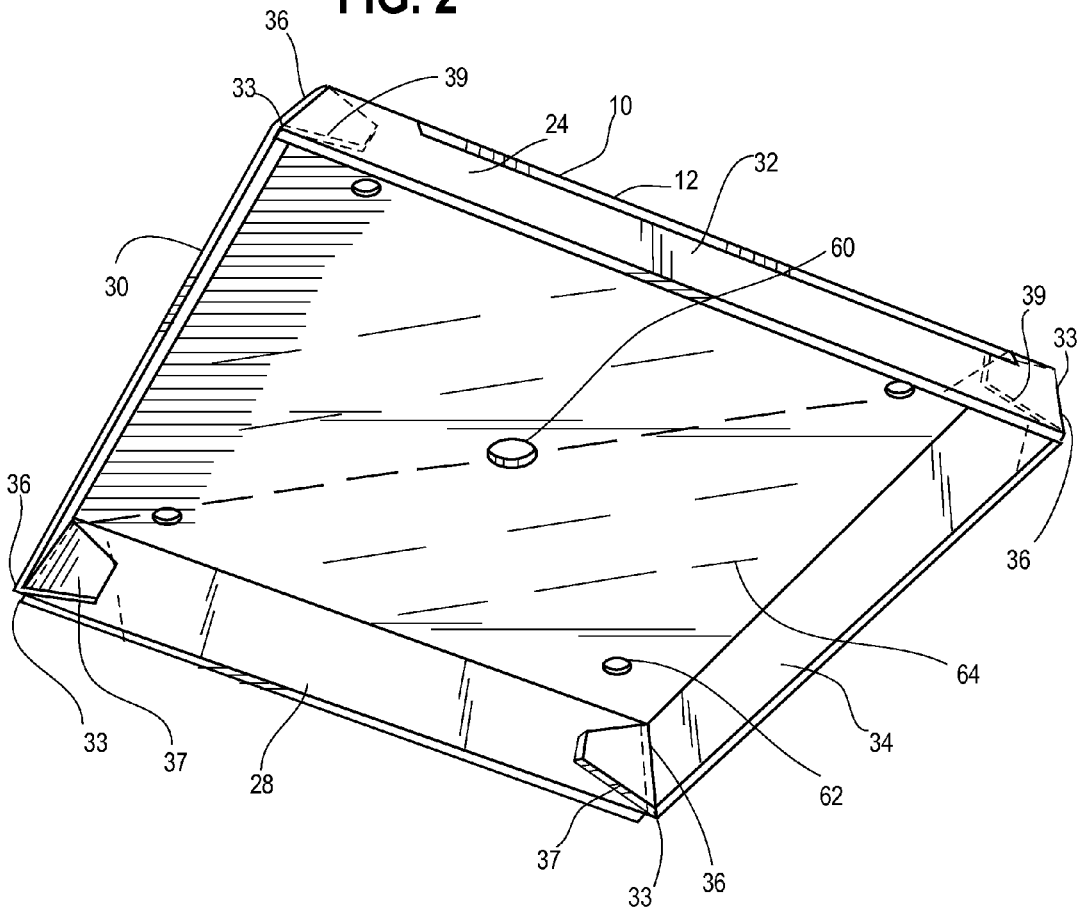
FIG. 2 is a bottom perspective view of the tray of FIG. 1.

Raised platforms having susceptor material for microwave cooking of a foldable food product and methods of use are described herein and illustrated in FIGS. 1-9. The raised platform has legs that extend to elevate a food product support surface having the susceptor material, and thus the food product, above the floor of the microwave during the cooking cycle to provide more even microwave cooking. The susceptor material is disposed on the raised platform in a configuration facilitating folding of the cooked food product with reduced cracking or breaking.

The raised platform 10 has a food product surface 12 for supporting a food product 14 at least partially on a susceptor surface 16. The susceptor surface 16 provides for conductive heating of portions of the food product 14 in contact therewith. After cooking, the food product surface 12 may be folded about a fold region 18 which is free from susceptor material. A fold zone of the food product immediately adjacent to the fold region 18 of the food product surface 12 does not experience the same degree of conductive heating and thus is more flexible. This facilitates folding of the food product about the fold zone with the end result being less cracking or breaking of the food product in the fold zone.

The food product surface 12 includes depending legs 20 to support the food product surface 12 in an elevated position, such as above the floor of a microwave oven. The legs 20 depend from a periphery 22 of the food product surface, as illustrated in FIG. 1. The legs 20 may be a series of segments that form a continuous sidewall 24 that extending partially or completely around the periphery 22 of the food product surface. In the illustrated example of a generally rectangular food product surface 12 having outer periphery edges 47, a first segment 28 may extend and connect to an adjacent second segment 30 which connects to an adjacent third segment 32 which connects to an adjacent fourth segment 34 to form the sidewall 24. Each segment has a longitudinal edge 31 connected to the food product support surface and a pair of transverse edges 33, each of which is attached to the adjacent segment to form a corner 36.

The food product surface 12 includes areas of susceptor material 46 on both sides of an area free of susceptor material 48. The area free of susceptor material 48 coincides with the fold region 18 which bisects the food product surface 12. The fold region 18 may extend from an edge 50 to an opposite edge 52 of the food product surface 12. In the example of FIG. 1, the fold region 18 extends from a corner region 66 to an opposite corner region 68 along a diagonal 70 of the food product surface 12. The fold region 18 includes a fold line or area, preferably, though not necessarily a weakened fold line 40, extending parallel to an outer edge 55 and opposite outer edge 57 of the fold region 18 and at least along a substantial length of the fold region 18 sufficient to facilitate folding. The weakened line 40 may extend within the fold region 18 in the area free from susceptor material 48 at a location spaced an equal distance away on both sides from the area containing susceptor material 46. By free of susceptor material, what is meant is that this region will have less conductive heating than the adjacent portions having the susceptor material 46. This includes a region entirely free of susceptor material, as well as a region that has less than the adjacent susceptor material 46. The objective is to crisp the fold zone of the food product to a lesser degree than the adjacent portions of the food product. The weakened line 40 may include perforations 44, or creases, scores or other areas of weakness that facilitate the folding of the food product surface 12 about the fold region 18.

Figure 7A:
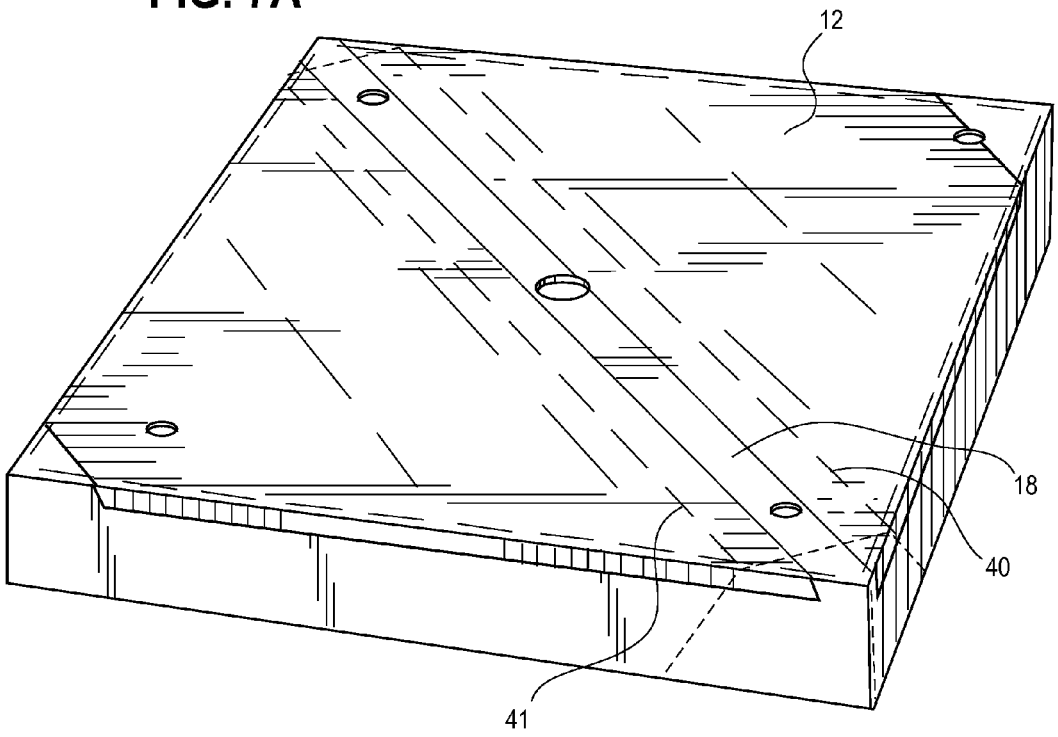
FIG. 7A is a top perspective view of an embodiment of a tray having an elevated food product support surface with a susceptor therein.
Figure 7B:
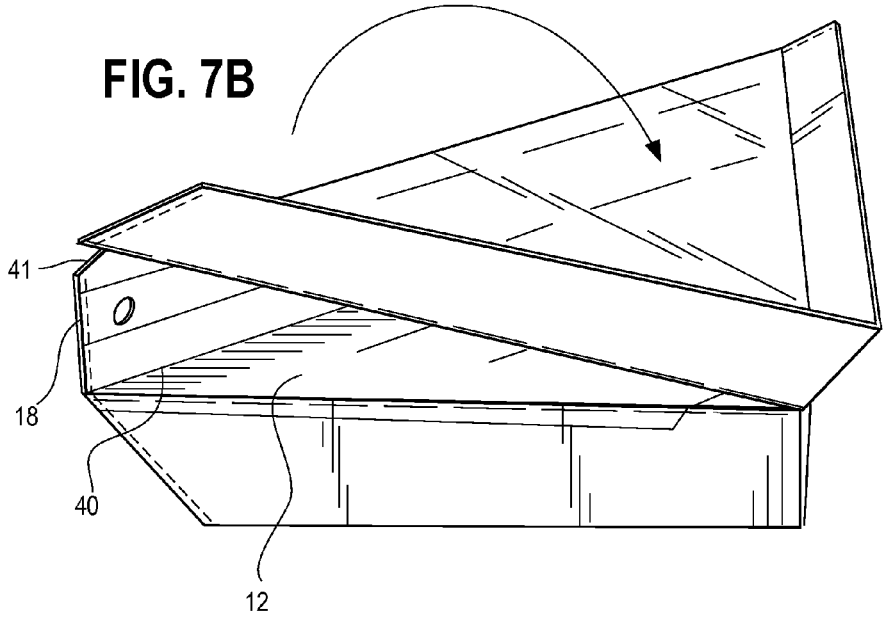
FIG. 7B is a perspective view of the tray of FIG. 7A in a folded position.

Referring to FIGS. 7A-7B, the fold region of the food product surface 12 may alternatively include at least two weakened lines 40, 41 that extend parallel to one another and extend the length of the fold region 18. The two weakened lines 40, 41 may include perforations, or a crease, scores, or other areas of weakness that facilitate folding along the weakened lines. Folding along the at least two weakened lines 40, 41 can allow the food product surface 12 to fold a thicker food product that is in contact with the food product surface 12. Furthermore, there can be a pair of spaced apart susceptor free zones on the food product surface with susceptor material therebetween, each having its own fold line of weakness.

Figure 3A:
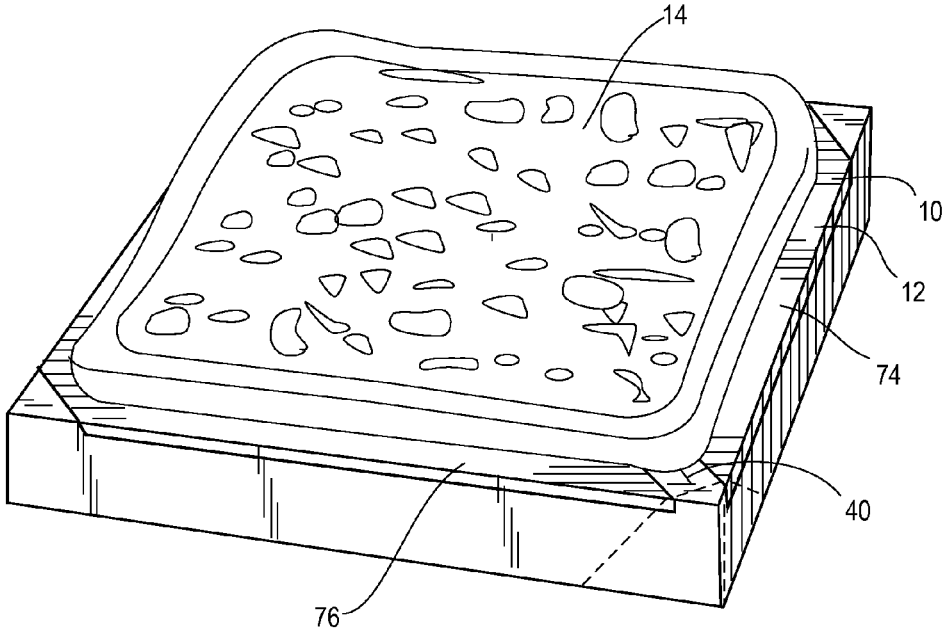
FIG. 3A is a top perspective view of the tray of FIG. 1 with a food product on the food product support surface.
Figure 3B:
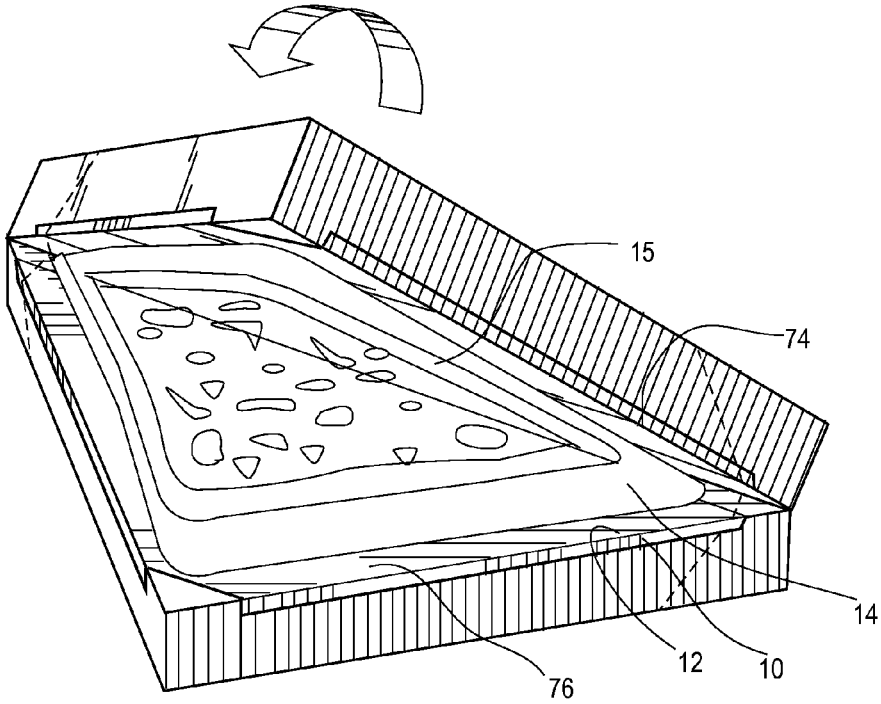
FIG. 3B is a perspective view of the tray and food product of FIG. 3A being folded.
Figure 3C:
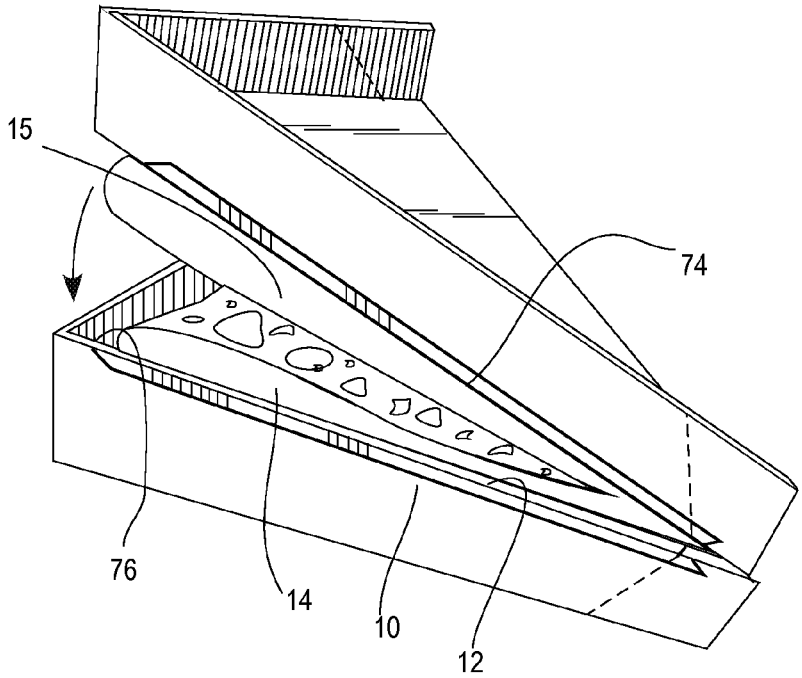
FIG. 3C is a perspective view of the tray and food product of FIG. 3A in a further folded position from that of FIG. 3B.
Figure 3D:
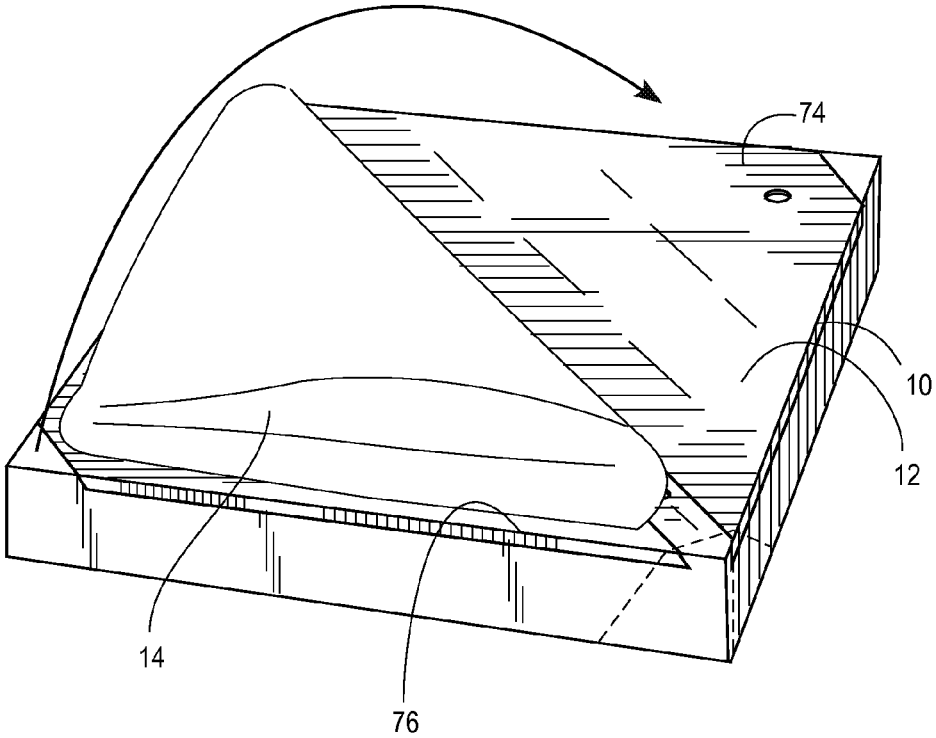
FIG. 3D is a perspective view of the tray and food product of FIG. 3A, showing the food product folded and the tray returned to its unfolded position.

The food product surface 12 can be used to fold the food product 14 thereon by moving the surface 12 from an initial open position, suitable for cooking; to a folded position; and back to the initial open position, leaving the folded food product on one half of the surface 12. In FIG. 3A, a first portion 74 and a second portion 76 of the food product surface 12 are separated by the weakened line 40 and the food product 14 rests on both the first portion 74 and the second portion 76 of the food product surface 12. In FIG. 3B and FIG. 3C, the first portion 74 contacts a portion of the food product 15 and can be folded about the weakened line 40 into close proximity with the second portion 76, which causes the portion of the food product 15 to move and position the food product 14 into a folded position. If necessary, and depending on the thickness of the food product 14, the first portion 74 may be folded to a position nearly parallel to the second portion 76 to position the food product 14 in the folded position. As illustrated in FIG. 3D, the first portion 74 of the food product surface is folded back to its initial position and the food product 14 is left in the folded position.

Figure 6A:
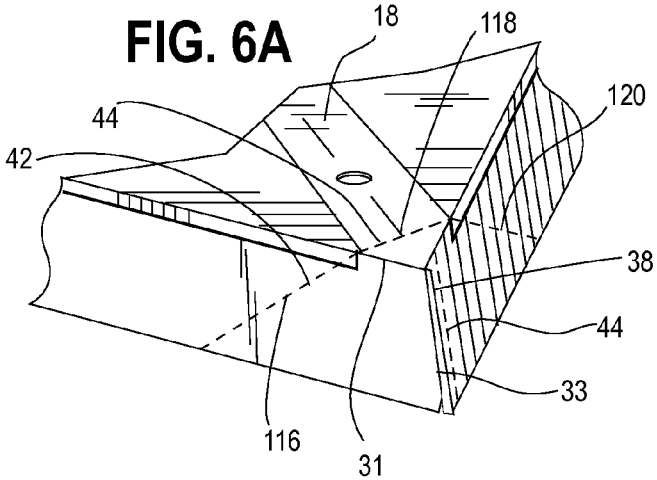
FIG. 6A is a partial perspective view of tray of FIG. 1, showing detail of perforations for removal of a corner region.
Figure 6B:
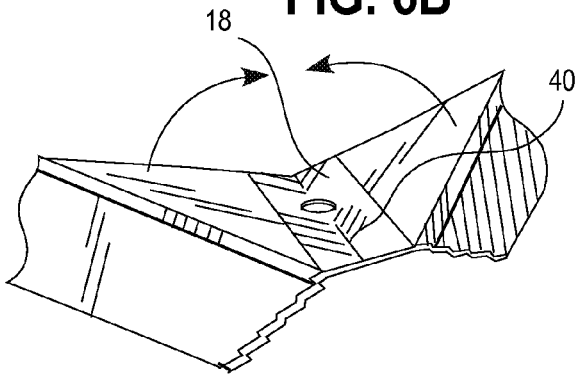
FIG. 6B is another partial perspective view of the tray of FIG. 1, similar to that of FIG. 6A, but showing the tray after removal of the corner region.
Figure 6C:
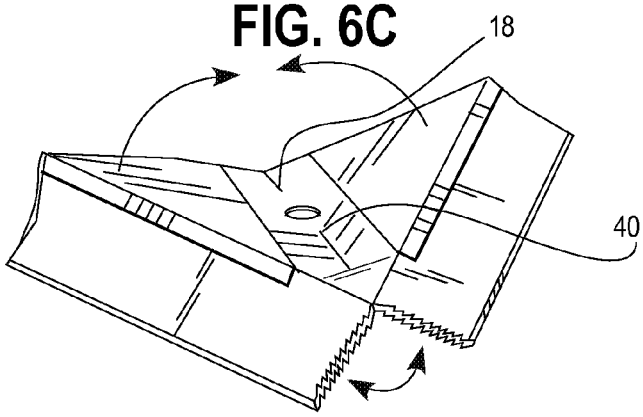
FIG. 6C is another partial perspective view of the tray of FIG. 1, similar to that of FIG. 6A, but showing a corner perforation being broken to permit folding of the tray.

The continuous sidewall 24 is initially configured to provide stability to the food product surface 12 during cooking and to prevent folding of the food product surface 12. This permits the food product surface 12 to support the food product 14 in an elevated position while cooking and handling during removal from the microwave oven following cooking without collapsing under the weight of the food product 14 resting thereon. After cooking is completed, the food product surface 12 may be configured to permit folding by breaking portions of the sidewall 24. In one configuration, the corners adjacent a diagonally extending line of weakness may be removed, as illustrated in FIG. 6B. In another configuration, suitable for both diagonally extending and side-to-side lines of weakness, the adjacent portions of the sidewall may be broken, as illustrated in FIG. 6C. Furthermore, these two configurations can be combined in one raised platform 10, as illustrated in FIG. 6A. While these two configurations are discussed herein with reference to being combined, they could also be provided separately.

One way of breaking the sidewall 24 to permit folding of the food product surface 12 along its weakened fold line 40 is to separate the sidewall 24 along a pair of weakened lines 38 formed therein and aligned with the weakened fold line 40, as illustrated in FIGS. 6A and 6C. In the illustrated example having a diagonally-extending weakened fold line 40, the weakened lines 38 are positioned in the sidewall 24 adjacent each corner adjacent to each end of the weakened fold line 40.

The weakened lines 38 may contain perforations 44, or creases, scores, or other areas of weakness that will allow breaking or tearing of the weakened line 38 in order to permit the sidewall 24 to be broken into two or more portions, which in turn permits folding of the food product surface 12 along its weakened fold line 40.

Another way of breaking the sidewall 24 to permit folding of the food product support surface 12 along its weakened fold line 40 is to remove the corner regions adjacent each end of the diagonally-extending weakened fold line 40. The corner regions are initially joined to the remainder of the raised platform 10 via a weakened corner line 42, which may contain perforations 44, or creases, scores, or other areas of weakness that will enable a user to break the weakened line 42. More specifically, the weakened corner line 42 includes surface line 118 extending between periphery edges of the food product surface 12 and generally orthogonal relative to the weakened fold line 40. An aligned weakened sidewall line 116 extends in one of the sidewall segments 28 from the surface line 118 at the periphery edge of the food product support surface 12 to the opposite longitudinal edge of the segment 28. Although not required, the weakened sidewall line 116 may extend at an inclined angle away from the corner 36. A similar weakened sidewall line 120 is located in the adjacent segment 34. This same structure of the weakened corner line 42 is also at the opposite corner at the opposite end of the diagonally-extending weakened fold line 40. Removal of the corner regions along the weakened corner lines 42 permits the sidewall 24 to be broken into two or more portions, which in turn allows the food product surface 12 to be folded along its weakened fold line 40.

Handling features may optionally be associated with the food product surface 12 to allow a user to fold the food product surface 12, and the food product 14 thereon after cooking without contacting the susceptor material 46. For instance, the food product surface may include susceptor free areas 98 that an individual can grasp to fold the food product surface 12, as well as any food product thereon. The susceptor free areas 98 may be located at corner regions of the food product surface 12 and at a position spaced from the fold region 18 by the susceptor material 46. The susceptor free areas 98 may be generally triangular in shape with a first side bordering a portion of a first outer periphery edge 124 and a second side bordering a portion of a second outer periphery edge 126 of the food product surface 12 and a third side 128 bordering the susceptor material 46. The individual may grasp at least one of the susceptor free areas 98 to fold the food product surface 12 about the weakened line 40. By not having susceptor material in the susceptor free areas 98, those areas 98 will not be as hot as other areas along susceptor material following microwave heating.

Figure 4:
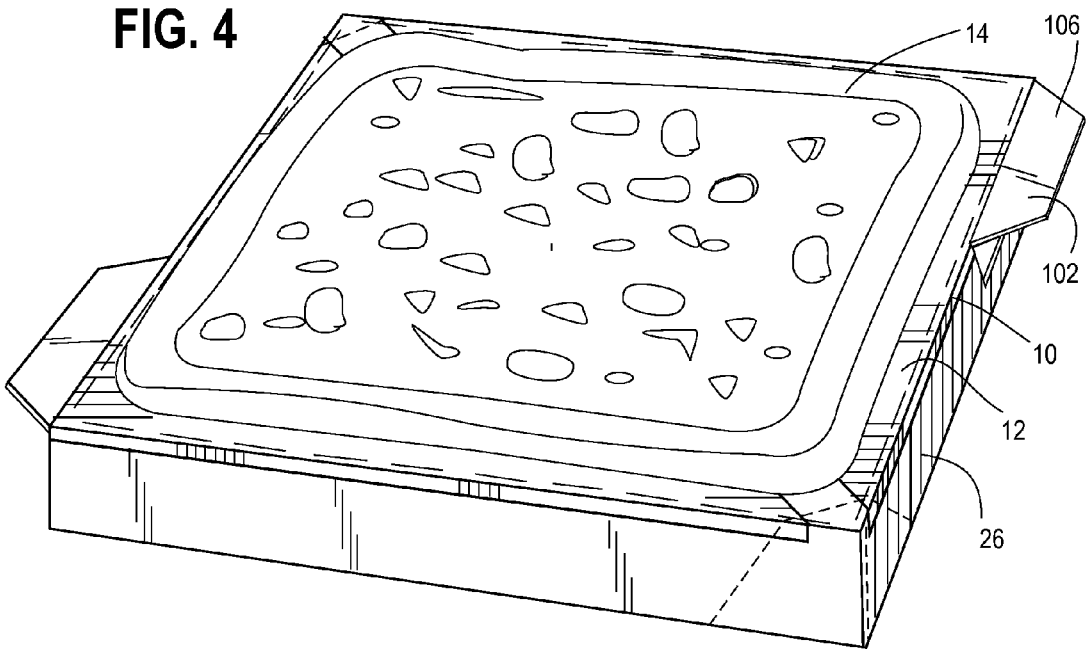
FIG. 4 is a perspective view of another embodiment of a tray having an elevated food product support surface with a susceptor therein, and having handles extending outwardly from depending legs.
Figure 5A:
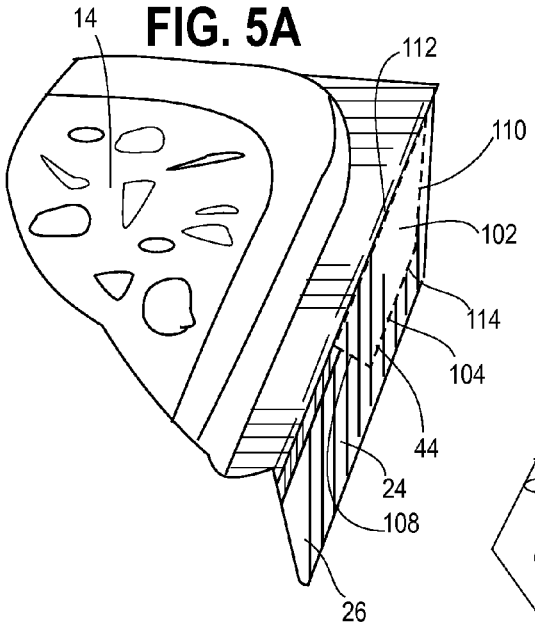
FIG. 5A is a partial perspective view of the tray of FIG. 4, showing one of the handles in an unextended position.
Figure 5B:
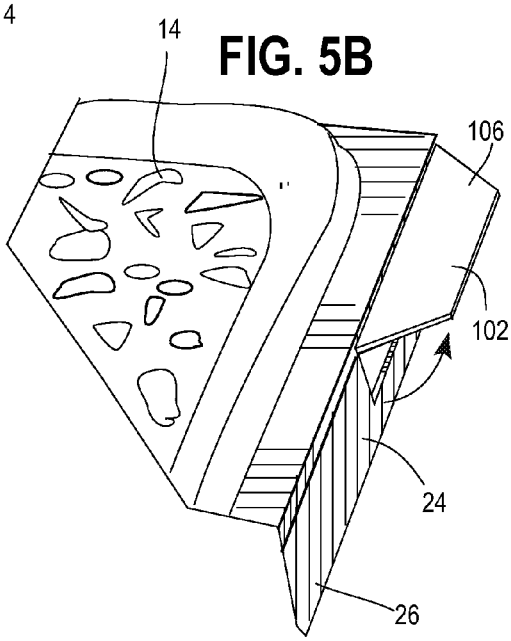
FIG. 5B is another partial perspective view of the tray of FIG. 4, showing one of the handles moving to an extended position.

Additionally, portions of the sidewall 24 in the example of FIGS. 4-5 may extend outward to allow an individual to fold the food product surface 12 without contacting the suscepter material 46. A flat portion 102 may be disposed on a segment 26 and include a series of connected weakened lines 104 or, alternatively, die cuts that require no or minimal breaking. The weakened lines 104 may include perforations 44, or creases, scores, or other areas of weakness that allow the weakened lines 104 to be folded or broken apart. The weakened lines 104 may be broken apart and folded such that an individual can grasp the flat portion 102 as a handle 106 to fold the food product surface 12. Specifically, the weakened lines 104 may include transverse line 108, opposite transverse line 110, a top line 112, and bottom line 114. Transverse line 108 and opposite transverse line 110 may be located on the segment 26 and extend in a direction that is generally transverse to the longitudinal edge 31 of the segment. Top line 112 and bottom line 114 may be located on the segment 26 and extend in a direction that is generally parallel to one another as well as the longitudinal edge 31 of the segment. In one example, transverse line 108, opposite transverse line 110, and the bottom line 114 in FIGS. 5A-5B are broken and separated so as to detach a section of the flat portion 102 from the segment 26. The top line 112 may remain attached and connected to the segment 26. The flat portion 102 is then folded about the top line 112 until the flat portion 102 extends outwardly from the segment 26 to a position generally parallel to the food product surface 12. Preferably, an opposite segment or adjacent segment will contain a similar flat portion capable of being folded outward from the segment and used as a handle 106. This enables the individual to grasp the handles and fold the food product surface 12 without contacting the susceptor material 46.

Turning to one example of the construction of the raised platform 10, opposite segments 30 and 34 each have flaps 37 and 39, respectively, at each of their transverse edges 33 that can be folded and adhered to inner surfaces of the other segments 28 and 32. Specifically, the second segment 30 has a pair of flaps 37 at each transverse edge 33. Both of the flaps 37 are folded inwardly, and one is adhered or otherwise affixed to the inner surface of the first segment 28 and the other is likewise adhered or otherwise affixed to the inner surface of the third segment 32. The fourth segment 34 has a pair of flaps 39 at each transverse edge 33. Both of the flaps 39 are folded inwardly, and one is adhered or otherwise affixed to the inner surface of the first segment 28 and the other is likewise adhered or otherwise affixed to the inner surface of the third segment 32, at opposite end portions from where the flaps 37 are attached.

Vents may be disposed at locations throughout the food product surface 12 to provide air flow and allow moisture to vent during microwaving and to provide the optimal environment for cooking and heating of the food product 14. Some of the vents may be disposed on the area free of susceptor material 48. Vents 60 in FIG. 1 and FIG. 2 may be generally circular and of varying sizes and may be disposed within the fold region 18. The vents 60 may be positioned towards the center of the fold region 18 and may be equally spaced on each side from the susceptor material 46. Moreover, susceptor vents 62 and slit vents 64 may be disposed on the susceptor material 46. Susceptor vents 62 are generally circular and may be positioned toward the outer periphery edge 47 of the food product surface. Slit vents 64 are generally rectangular and may form narrow slits that extend parallel to the fold region 18. Other vent patterns and shapes can be equally suitable.

The food product surface 12 is configured to be used for cooking and then folding of a food product 14 by folding the food product about a flexible fold zone located on the food product. In one example, the user may place the food product 14 on the food product surface 12 of the raised platform 10 and place the platform 10 with the food product 14 thereon in a microwave oven for heating or cooking. The food product 14 is crisped or browned in response to the heating or cooking in the microwave oven in areas that are in contact with the susceptor material disposed on the food product surface 12. However, the food product 14 is not crisped or browned in areas where it is not in contact with the susceptor material 46. In one example, the food product surface 12 includes an area free from susceptor material along a fold region 18 that allows the food product 14 to experience a lesser degree of conductive heating within a fold zone of the food product 14 and therefore more flexible for folding along the fold zone. After cooking, the user may remove the raised platform 10 and the food product 14 from the microwave oven. The user may break weakened lines 38 disposed on the legs 20 and separate adjacent segments of the sidewall to allow the folding of the food product surface 12 and the food product 14. Alternatively, the user may break the weakened corner line 42 to remove the corners which extend at the opposite edges of the fold region 18. This configuration allows the food product surface 12, and the food product 14, thereon to be folded. Handling features are provided that allow the user to fold the food product surface 12 and the food product 14 without contacting the susceptor material. In one example, optional susceptor free corners are available for the user to grasp to fold the food product surface 12 and the food product 14. In addition or in the alternative, a user may grasp optional handles that extend outwardly from a flat portion located on the sidewall segments to fold the food product surface 12 and the food product 14. The user may grasp these handling features to fold the food product surface 12 and the food product 14 and position the food product 14 in a folded position, such as illustrated in FIG. 4.

In one example of a raised platform 10, the food product surface 12 may be generally rectangular and about 6.5 inches long by about 6.5 inches wide, and the legs 20 may have a height of about 1 inch. By way of example, food products that can be cooked using the raised platform 10 include a flat-bread product, pizza crust, pita bread, naan, gyro, taco, and the like, having a bread or dough formulated bottom with toppings thereon. The susceptor material 46 can provide browning or crisping of the bottom of the food product during microwave heating, with the exception discussed herein of the fold zone. After heating, the food product surface 12 can be folded to fold the food product and place the toppings on top of each other.

Figure 8:
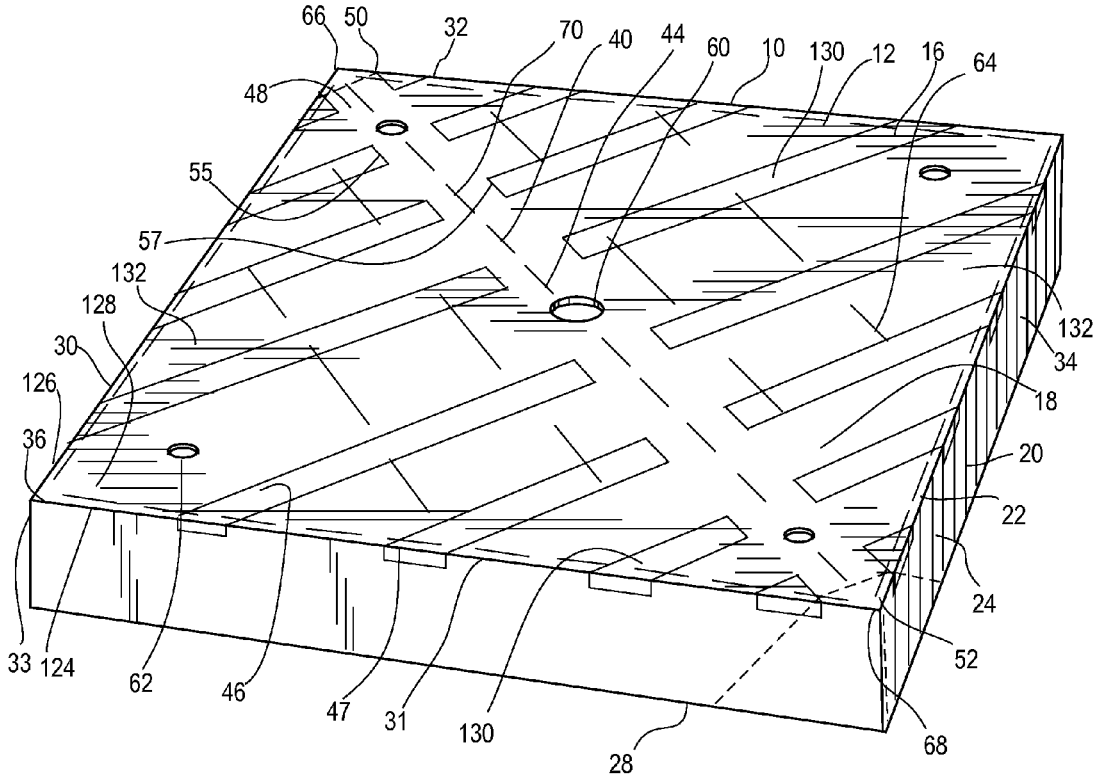
FIG. 8 is a top perspective view of an embodiment of a tray having an elevated food product support surface with susceptor material on an upper side thereof in a stripped pattern.

Referring now to FIG. 8, in one form, the raised platform 10 may be adapted to provide food products with patterned browned or crisped areas after microwave heating. The raised platform 10 includes the food product surface 12 for supporting a food product 14 at least partially on the susceptor surface 16. The food product surface 12 includes the legs 20, which depend from the food product surface 12 and support the food product surface 12 in an elevated position, such as above the floor of a microwave oven. In this form, the susceptor surface 16 can be disposed on the food product surface 12 in a pattern that, during microwave heating, will brown the pattern into the food product 14.

In the illustrated form, the susceptor surface 16 includes a series of generally parallel strips or lines 130 spaced apart by substantially susceptor material-free areas 132. A shield could also be used between the strips 130. During microwave heating, the strips 130 brown the food product 14, which creates the appearance of the food product 14 being grilled or browned by a panini press. The strips 130 may have a width in the range of approximately ⅛ to 1 inch. Additionally, the susceptor material-free areas 132 may having a width in the range of approximately ⅛ to 1 inch.

The raised platform 10 may further include the fold region 18 including the area free of susceptor material 48 and the weakened line 40. As illustrated, the strips 130 are substantially perpendicular to the fold region 18. Alternatively, the strips 130 may be disposed generally parallel to or at angle to the fold region 18. Additionally, the food product surface 12 can include any suitable pattern of the slit vents 64 and the susceptor vents 60, 62.

Figure 9:
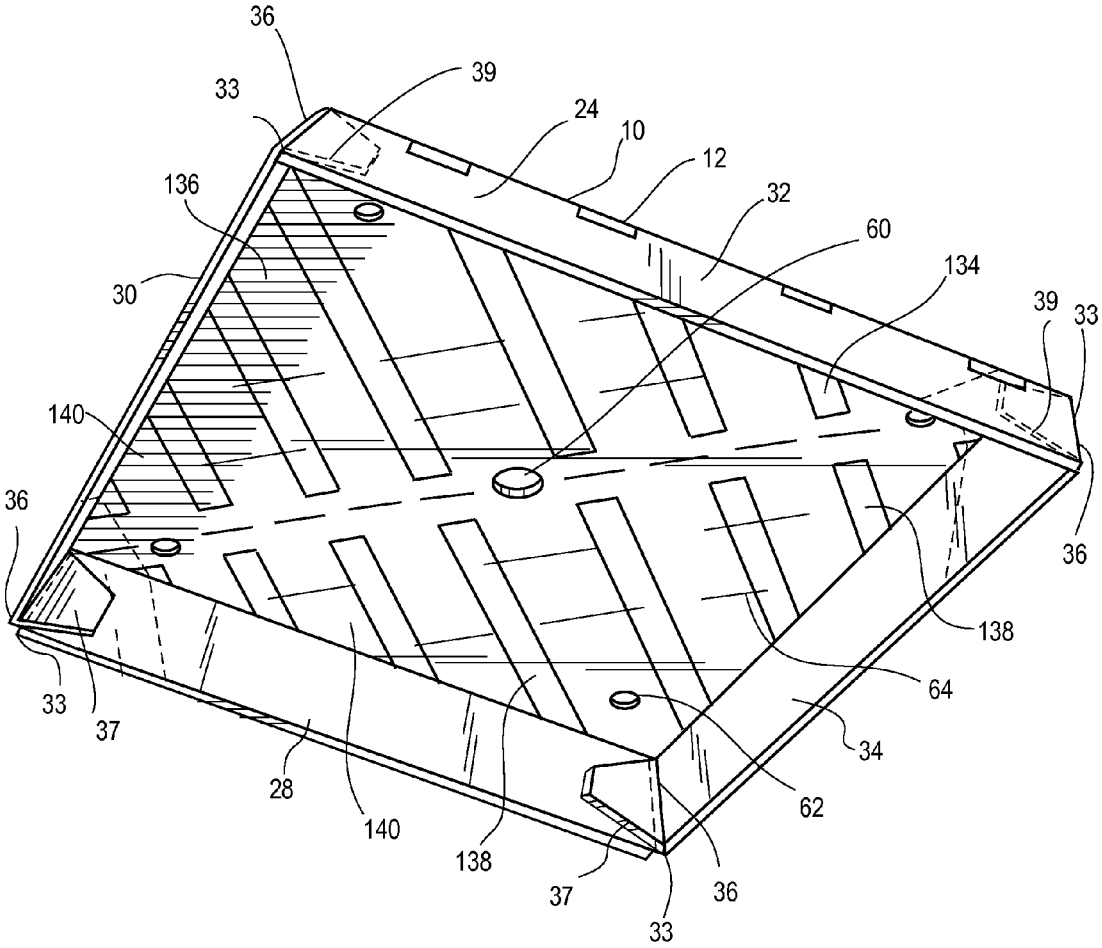
FIG. 9 is a bottom perspective view of the tray of FIG. 8 showing susceptor material on a lower side of the food product support surface in a stripped pattern substantially underlying the susceptor material on the upper side thereof.

In a further form, and referring now to FIG. 9, a second susceptor surface 134 may be disposed on a bottom surface 136 of the food product surface 12 of the raised platform 10 and may optionally lie directly beneath or at least partially lie beneath the susceptor strips 130. on the top surface of the food product support surface 12 The second susceptor surface 134 can work in conjunction with the susceptor surface 16 on the food product surface 12 to provide additional heat to the food product 14 during microwave heating. Alternatively, the second susceptor surface 134 may be disposed on a second support positioned beneath the food product surface 12. Likewise, other susceptor surfaces can being disposed on top or bottom surfaces of additional support layers.

As illustrated, the second susceptor surface 134 is formed as a series of generally parallel strips or lines 138 spaced apart by substantially susceptor material-free areas 140. The strips 138 are substantially aligned with the strips 130 on the food product surface 12 in order to create clearly defined browned lines on the food product 14 during microwave heating. Having susceptor material on the top and bottom of the food product surface 12 browns the food product 14 in contact with the susceptor surface 16 more consistently and thoroughly than if only on the top surface. Accordingly, when the susceptor material is arranged into a pattern, such as the strips 130, 138 illustrated in the examples, the susceptor surface 16 and the second susceptor surface 134 can combine to create clearly defined browned lines on the food product 14.

As described herein, the susceptor surface 16 and the second susceptor surface 134 can include the strips 130, 138. Alternatively, the susceptor surface 16 and/or the second susceptor surface 134 may form other suitable patterns, including arcuate lines, diagonal lines, concentric circles, graphical content, alphanumerical content, or combinations thereof. In addition, providing the fold line and/or susceptor-free fold region can be combined with the aligned strips 130, 138.

The dough formulation described herein provides a bread product, preferably a flat-bread product, pizza crust, pita bread, naan, gyro, taco, and the like, having a crispy bottom surface while the remainder of the bread product has a soft and airy texture upon cooking in a microwave oven.

The bread formulations disclosed herein are designed so as to provide good organoleptic properties and a crisp bottom surface while the remainder of the bread product has a soft, airy texture after microwaving. Thus, the use of the bread formulations provided herein have better organoleptic properties as similar microwaveable products prepared with conventional dough formulations, including conventional dough formulations used in microwaveable products currently available in the marketplace. Although the dough formulations described herein are especially designed for use in flat-bread food products, the dough formulations can be used to advantage in other bread products, including those intended to be heated in microwave ovens, such as flat-bread products, pizza crust, pita bread, naan, gyros, tacos, and the like.

For purposes herein, "bread" product refers to fully-baked or par-baked thin bread products such as, for example, a flat-bread product, pizza crust, pita bread, naan, gyro, taco, and the like.

It has surprisingly been discovered that a yeast and/or chemically-leavened dough comprising wheat protein isolate and fat chips can be used to provide a frozen baked bread product that, after cooking in a microwave or conventional oven, having a crispier bottom surface while the remainder of the bread product has a softer and airier texture as compared to otherwise similar bread products prepared from leavened dough not including wheat protein isolate and fat chips, as described in U.S. Provisional Application 61/094,957. It is believed that the fat chips melt during baking, thus leaving voids that are filled by carbon dioxide produced by the leavening agent. While not wishing to be limited by theory, it is believed that the wheat protein isolate provides a soft dough which allows the carbon dioxide gas bubbles to expand the dough while also providing sufficient strength to the dough such that the dough is able to maintain the porous structure formed by the gas bubbles, thus forming a light, airy, soft texture to the bread product.

An illustrative and preferred recipe (in baker's percentages) for dough prepared according to an embodiment of the invention is provided in Table 1 below.

TABLE 1

| Ingredient | Illustrative Recipe (% flour basis) | Preferred Recipe (% flour basis) |
|---|---|---|
| Flour | 100 | 100 |
| Compressed yeast | 0.5-5 | 2-3 |
| Encapsulated leavening agent | 0-2 | 0.1-0.5 |
| Leavening acid | 0-1 | 0.1-0.5 |
| Salt | 0-4 | 1-3 |
| Sweetener | 0.5-6 | 0.5-1.5 |
| Wheat protein isolate | 0.05-5 | 0.1-0.3 |
| Fat chips | 0.5-10 | 5-9 |
| Vital wheat gluten | 0-8 | 1-3 |
| Water | 55-70 | 58-60 |
| Oil | 0-8 | 3-5 |

If desired, the baked or par-baked bread product may include a variety of toppings, such as, but not limited to, meat, cheeses, vegetables, tofu, soy, soy derivatives, sauces, dressings, spreads, gravies, condiments, spices, herbs, flavorings, colorants, and the like. Further details regarding the dough and its formulations are disclosed in a U.S. Provisional Patent Application 61/094,957 filed on Sep. 7, 2008, entitled "Dough Product, Microwaveable Frozen Bread Product, and Method for Making Same", which is hereby incorporated by reference in its entirety.

The drawings and the foregoing descriptions are not intended to represent the only forms of the food product surface containing susceptor material in regard to the details of construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation.

What is claimed is:

1. A raised platform for microwave heating of a food product, the platform comprising:

a food product support surface configured to support a food product thereon during microwave heating of the food product;

legs depending from the food product support surface;

susceptor material disposed on both sides of a fold region of the support surface, the fold region being substantially free of the susceptor material;

a fold line extending across the food product support surface within the fold region about which the food product support surface and the food product thereon can be folded; and one or more weakened lines adjacent to ends of the fold line of the food product support surface.

2. The raised platform for microwave heating of a food product of claim 1 wherein the legs depend from the periphery of the food product support surface.

3. The raised platform for microwave heating of a food product of claim 2 wherein the food product support surface is generally rectangular and the fold line is disposed along a diagonal of the food product support surface.

4. The raised platform for microwave heating of a food product of claim 3 wherein the one or more weakened lines comprise a weakened corner line positioned adjacent each corner aligned with the fold line to allow removal of at least a portion of a corner region to permit the food product support surface to be folded along the fold line.

5. The raised platform for microwave heating of a food product of claim 4 wherein each of the weakened corner lines extends along a pair of intersecting legs and a corner of the food product support surface.

6. The raised platform for microwave heating of a food product of claim 1 wherein the fold line is a weakened line.

7. The raised platform for microwave heating of a food product of claim 1 wherein edge portions of the food product support surface spaced from the fold region by the susceptor are free from susceptor material.

8. The raised platform for microwave heating of a food product of claim 1 wherein at least one of the legs has a flap that can be folded outwardly for use as a handle.

9. The raised platform for microwave heating of a food product of claim 1 wherein the support surface has two or more parallel, weakened fold lines.

10. The raised platform for microwave heating of a food product of claim 1 wherein the one or more weakened lines comprise a pair of weakened lines in the legs aligned with the fold line of the food product support surface to permit, when broken, the food product support surface to be folded along the fold line.

11. A method of microwave heating of a food product using a susceptor tray, the method comprising:

positioning a food product on an elevated support surface, the support surface elevated by depending legs;

conducting heat using a pair of spaced susceptors during microwave heating to only portions of the food product spaced from a linear fold region being substantially free from susceptor material and capable of providing the food product with a substantially uncooked fold zone about which the food product can be folded to maintain flexibility of the food product;

breaking one or more weakened lines positioned adjacent to ends of the linear fold region; and folding the elevated support surface to fold the food product about the linear fold region.

12. The method of microwave heating of a food product of claim 11 wherein the conducting heat step further includes the substantially uncooked fold zone of the food product coinciding with the linear fold region.

13. The method of microwave heating of a food product of claim 11 wherein the step of folding the elevated support surface further includes the step of folding along a weakened fold line of the support surface disposed within the fold region of the elevated support surface.

14. The method of microwave heating of a food product of claim 13 wherein the depending legs are configured to prevent folding of the food product support surface and wherein the step of breaking the one or more weakened lines comprises breaking a pair of weakened lines in the legs aligned with the fold line of the food product support surface to permit folding of the food product support surface.

15. The method of microwave heating of a food product of claim 11 wherein the step of folding the elevated support surface further includes the step of grasping edge portions that are spaced from a weakened fold line by the susceptors and are free from susceptor material.

16. The method of microwave heating of a food product of claim 11 wherein the support surface is generally rectangular and the step of folding the support surface further includes the step of diagonally folding the support surface.

17. The method of microwave heating of a food product of claim 16 wherein the depending legs are configured to prevent folding of the food product support surface and wherein the step of breaking the one or more weakened lines comprises breaking corner lines positioned adjacent each corner aligned with the weakened fold line to allow removal of at least a portion of a corner region to permit folding of the food product support surface.

18. The method of microwave heating of a food product of claim 11 further including the step of folding a handle outwardly from a leg of the food product support surface.

19. A raised platform for heating a food product in a microwave oven, the raised platform comprising:

means for providing a dual texture to a surface of the food product after microwaving, said means including a food support surface having differential absorbtivities effective to provide said dual texture having a crispy area and a less crispy area wherein the less crispy area can be folded with comparatively less cracking of the less crispy area;

a fold line extending across the food support surface about which the food support surface and food product thereon can be folded; and legs depending from the food support surface having one or more weakened lines therein adjacent to ends of the fold line of the food support surface.

20. A raised platform for microwave heating of a food product, the platform comprising:

a food product support surface for supporting a food product during microwave heating of the food product;

legs depending from the food product support surface;

at least two fold lines extending across the food product support surface about which the food product support surface and any food product thereon can be folded;

one or more weakened lines adjacent to ends of the at least two fold lines; and susceptor material of the food product support surface disposed on both sides of a fold region of the support surface, the fold region extending along the support surface at a location between the at least two fold lines.

21. The raised platform for microwave heating of a food product of claim 20 wherein the legs depend from the periphery of the food product support surface.

22. The raised platform for microwave heating of a food product of claim 21 wherein the food product support surface is generally rectangular and the at least two fold lines are disposed generally parallel to a diagonal of the food product support surface.

23. The raised platform for microwave heating of a food product of claim 22 wherein the one or more weakened lines comprise a weakened corner line positioned adjacent each corner aligned with the at least two fold lines to allow for removal of at least a portion of a corner region to permit the food product support surface to be folded along the at least two fold lines.

24. The raised platform for microwave heating of a food product of claim 23 wherein each of the weakened corner lines extends along a pair of intersecting legs and a corner of the food product support surface.

25. The raised platform for microwave heating of a food product of claim 20 wherein the at least two fold lines are weakened lines.

26. The raised platform for microwave heating of a food product of claim 20 wherein edge portions of the food product support surface spaced from the fold region by the susceptor are free from susceptor material.

27. The raised platform for microwave heating of a food product of claim 20 wherein at least one of the legs has a flap that can be folded outwardly for use as a handle.

28. A raised platform for heating a food product in a microwave oven, the raised platform comprising:

a food product support having a top surface and a bottom surface, the top surface being configured for supporting a food product during microwave heating of the food product;

legs depending from the food product support surface;

first susceptor material disposed on the top surface of the food product support in a first pattern including regions spaced from each other by regions free from susceptor material;

second susceptor material disposed on the bottom surface of the food product support in a second pattern substantially identical to and aligned with the first pattern of the first susceptor material;

one or more fold lines extending across the food product support about which the food product support and any food product thereon can be folded; and one or more weakened lines positioned adjacent to ends of the one or more fold lines.

29. The raised platform of claim 28, wherein the first and second patterns comprise a plurality of generally parallel bars of susceptor material.

30. The raised platform of claim 28, wherein the food product support includes a fold region that extends on sides of the one or more fold lines and is free of susceptor material.

31. The raised platform claim 30 wherein the one or more legs are configured to break to permit folding of the platform about the fold region.

32. The raised platform of claim 30 wherein the food product support is generally rectangular and the one or more fold lines are disposed along a diagonal of the food product support.

33. The raised platform of claim 28 wherein the one or more fold lines comprise two or more parallel fold lines extending across the food product support about which the food product support and any food product thereon can be folded, and wherein there is a fold region that extends between and on sides of the two or more parallel fold lines and is free of susceptor material.

34. The raised platform of claim 28 wherein the one or more weakened lines comprise a weakened corner line positioned adjacent to corners of the food support aligned with the one or more fold lines to allow removal of at least a portion of a corner region to permit the food product support surface to be folded along the fold line.

* * * * *

UNITED STATES PATENT AND TRADEMARK OFFICE

CERTIFICATE OF CORRECTION

PATENT NO. : 8,710,410 B2
APPLICATION NO. : 12/553837
DATED : April 29, 2014
INVENTOR(S) : Patrick A. Gowens et al.

It is certified that error appears in the above-identified patent and that said Letters Patent is hereby corrected as shown below:

In The Claims

In claim 29, replace "claim 28, wherein" with --claim 28 wherein--

In claim 30, replace "claim 28, wherein" with --claim 28 wherein--

In claim 31, replace "platform claim 30" with --platform of claim 30--

Signed and Sealed this
Twenty-fourth Day of May, 2016

Michelle K. Lee

Michelle K. Lee
*Director of the United States Patent and Trademark Office*